US006209759B1

(12) United States Patent
Hermouet et al.

(10) Patent No.: US 6,209,759 B1
(45) Date of Patent: Apr. 3, 2001

(54) HAND-OPERATED PUMP WITH A FREE FLOATING SLEEVE PISTON

(75) Inventors: Yannic Hermouet, Verneuil sur Seine; Stéphane Beranger, Surtauville; Claude Jouillat, Montigny sur Avre, all of (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/346,821

(22) Filed: Jul. 2, 1999

Related U.S. Application Data

(63) Continuation-in-part of application No. 08/987,848, filed on Dec. 9, 1997, now abandoned.

(30) Foreign Application Priority Data

Jul. 4, 1997 (FR) ..... 97 08526
Jul. 3, 1998 (EP) ..... 98401668

(51) Int. Cl.[7] ..... B65D 88/54
(52) U.S. Cl. ..... 222/321.2; 222/385
(58) Field of Search ..... 222/321.7, 321.1, 222/321.9, 385, 321.2

(56) References Cited

U.S. PATENT DOCUMENTS 3,500,761 * 3/1970 Clevenger et al. ..... 222/321.1
3,583,605 * 6/1971 Corsette ..... 222/321
4,065,038 12/1977 Magers et al. .
4,911,336 3/1990 Blake .
4,958,752 9/1990 Maerte et al. .

FOREIGN PATENT DOCUMENTS 453 357 B1 6/1995 (EP) .
0757004 A1 2/1997 (EP) .
0888824 1/1999 (EP) .
1544683 11/1968 (FR) .
2399286 3/1979 (FR) .
2563287 10/1985 (FR) .
2576365 7/1996 (FR) .
2091818 8/1982 (GB) .
WO 95/29016 11/1995 (WO) .

* cited by examiner

*Primary Examiner*—Kevin Shaver
*Assistant Examiner*—David Deal
(74) *Attorney, Agent, or Firm*—Rockey, Milnamow & Katz, Ltd.

(57) ABSTRACT

A hand-operated pump for fluid distribution comprising a pump body defining a pump chamber, a hollow control rod traveling in the pump body between a rest position and a depressed, lower position, a free floating piston assembled in a sliding manner on the control rod, the piston and the rod serving to define an outlet valve, characterized in that the outlet valve exhibits a cylindrical tight sealing contact adapted to open by sliding the piston towards the top on the rod at a determined height and the rod includes a surface engaged by the piston and widening in a vertical direction towards the top.

10 Claims, 3 Drawing Sheets

HAND-OPERATED PUMP WITH A FREE FLOATING SLEEVE PISTON

CROSS REFERENCE TO RELATED APPLICATION(S)

This is a continuation-in-part of U.S. patent application Ser. No. 08/987,848 filed Dec. 9, 1997, now abandoned.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention concerns a hand-operated pump for fluid distribution, such as perfume, and concerns most specifically a hand-operated pump for fluid distribution including:

- a pump body defining a pump chamber with an input valve,
- a hollow control rod incorporating an inner duct, said rod being movable in the pump body between a lock position and a depressed, lower position, said rod being biased to the lock position by a return spring,
- a free floating piston assembled in a sliding manner on the control rod, the piston and the rod serving to define an outlet valve, closing off the inner duct in the lock position.

BACKGROUND OF THE INVENTION AND TECHNICAL PROBLEMS POSED BY THE PRIOR ART

A pump of this type is especially known in document EP-A-0 453 357. This pump comprises a control rod traveling in a pump body. The piston in the form of an elastic moldable sleeve is mounted on the control rod. This piston slides in a tight or sealing manner against the inner wall of the pump body and likewise closes the intersecting ducts which lead to the inner duct of the control rod. The upper end of the sleeve which forms the piston is a catch support for the shoulder that forms the control rod. Thus, as soon as the pressure increases to a satisfactory level, the sleeve is formed by resting on the catch support for the control rod collar so that the pressurized fluid in the pump chamber flows through these intersecting ducts and the inner duct of the control rod. In the pump described in this document (EP-A-0 453 357), the piston/sleeve is therefore always subjected to stress which occurs at the top of the sleeve between the shoulder catch device of the control rod and the tight duct of the piston lip with the inner section of the pump body. Accordingly, the sleeve is likely to get out of shape with the effect of this permanent stress so that it no longer seals perfectly tightly the intersecting ducts of the control rod.

Another pump of the same type is known from document FR-1 544 683. The pump described in this document likewise includes a control rod on which is mounted a piston in the form of a sleeve. The piston comprises tightness lips with an impenetrable slide against the inner section of the pump body. The sleeve seals tightly the intersecting ducts which lead to the central duct of the control rod. In a manner similar to the document cited above, the top end of the sleeve supports the shoulder that forms the control rod. The sleeve comprises a section of less thickness which gives it a certain elastic deformability. This elastic deformability is for the purpose of clearing intersecting ducts when the inner pressure of the pump chamber reaches an adequate level. There again, the sleeve is permanently subjected to an axial stress which occurs between the shoulder support of the control rod and another lower support which likewise forms the control rod right below the intersecting ducts.

We are likewise familiar with other pumps of this type using a free floating sleeve piston mounted on the control rod. Certain ones use a precompression spring that require the piston to be in a position that is suitable for sealing the control rod intersecting ducts. We can specifically cite document FR-A-2 399 286. Other pumps using earlier techniques do not use any device that calls for the free floating piston so that there is no precompression.

SUMMARY OF THE INVENTION

The purpose of the present invention is to reduce the difficulties cited above regarding earlier techniques by defining a precompression, hand-operated pump in which the piston sleeve is not subjected to any permanent stress, and that accordingly, exhibits a stronger resistance to wearing out.

In order to attain this goal, the purpose of the present invention is to provide a hand-operated pump for fluid distribution comprising:

- a pump body defining a pump chamber with an inlet valve,
- a hollow control rod traveling in the pump between a lock position and a drive-in position or depressed position, said rod being biased to the lock position by a return spring, said rod comprising an inner lift duct,
- a free floating piston assembled in a sliding manner in the pump body on the control rod,
- the piston and rod serving to define an outlet valve for sealing the inner lift duct in the lock position,
- the outlet valve exhibiting a cylindrical sealing contact or tight contact which is adapted to become loose by sliding the piston towards the top on the rod at a determined height.

The present control rod has a tapered surface extending outwardly on which the piston acts during its sliding towards the top. The combination of a cylindrical sealing contact or tightness contact exhibiting a certain height and a tapered functioning surface on which the piston is mounted during its sliding towards the top with the pressure effect extending in the pump chamber allows for obtaining a precompression which is dependent on the top of the cylindrical contact, on the conical angle of the tapered surface and on the material forming the piston. Because of the tapered surface, there can be the passing through said precompression spring whose purpose is to force the piston towards the bottom.

According to the layout shape, the piston comprises a sleeve surrounding the control rod, said sleeve exhibiting a lower part in cylindrical tight contact or sealing contact with the control rod and a higher end adapted to function on the tapered rod surface when the piston slides toward the top.

In contrast, in pumps using previous techniques, the sleeve was bent out of shape by deflection by supporting its upper end against the support collar, while in the present invention, the upper end of the sleeve can slide. In the present invention, the upper end of the sleeve can slide on a tapered surface by undergoing radial distortion. The use of a tapered surface allows for a standard constant sleeve distortion, whereas, with the previous technique devices, it was difficult to reduce sleeve deflection. The result is that it is easier to determine the force that is necessary to apply to the sleeve to use it at a certain distance on the tapered surface. Thus, with a defined moldable material, it is possible to determine the conic angle of the tapered surface and the height of the cylindrical tight contact so as to obtain adequate precompression.

In order to improve cylindrical tightness, the control rod comprises materials to radially compress the lower end of the sleeve.

In accordance with the layout shape, the control rod has, at its lower end, a peripheral compression device allowing for the compressing of the lower end of the sleeve between the rod and said peripheral device.

Advantageously, the peripheral compression device comprises a rod-concentric cylindrical surface, thus defining a unit—a reception groove with tight clamping for the lower part of the sleeve, linking the inside of the control rod with the pump chamber.

Thus, the height of the concentric cylindrical surface for the peripheral compression device determines the height of the lost motion during which the sleeve remains in tight contact with this concentric cylindrical surface and thus seals the outlet valve.

In accordance with another characteristic of the invention, the piston comprises a peripheral shoulder located at an intermediate level between the higher end and the lower end of the collar, said shoulder resting against a stationary element of the pump when the rod is in a lock position so that the sleeve is not in a compression state when locked.

In accordance with another aspect of the invention, the piston comprises an outer peripheral tightness bead or cord adapted to slide tightly against an inner cylindrical section from the lock position to the proximity of the lower or depressed position where the cord leaves said section thus to allow for venting of air only at the end of the stroke.

The invention will now be described more comprehensively with reference to the attached drawings giving by way of a non-limiting example a layout mode for the present invention.

DESCRIPTION OF THE PREFERRED EMBODIMENTS

Figure 1:
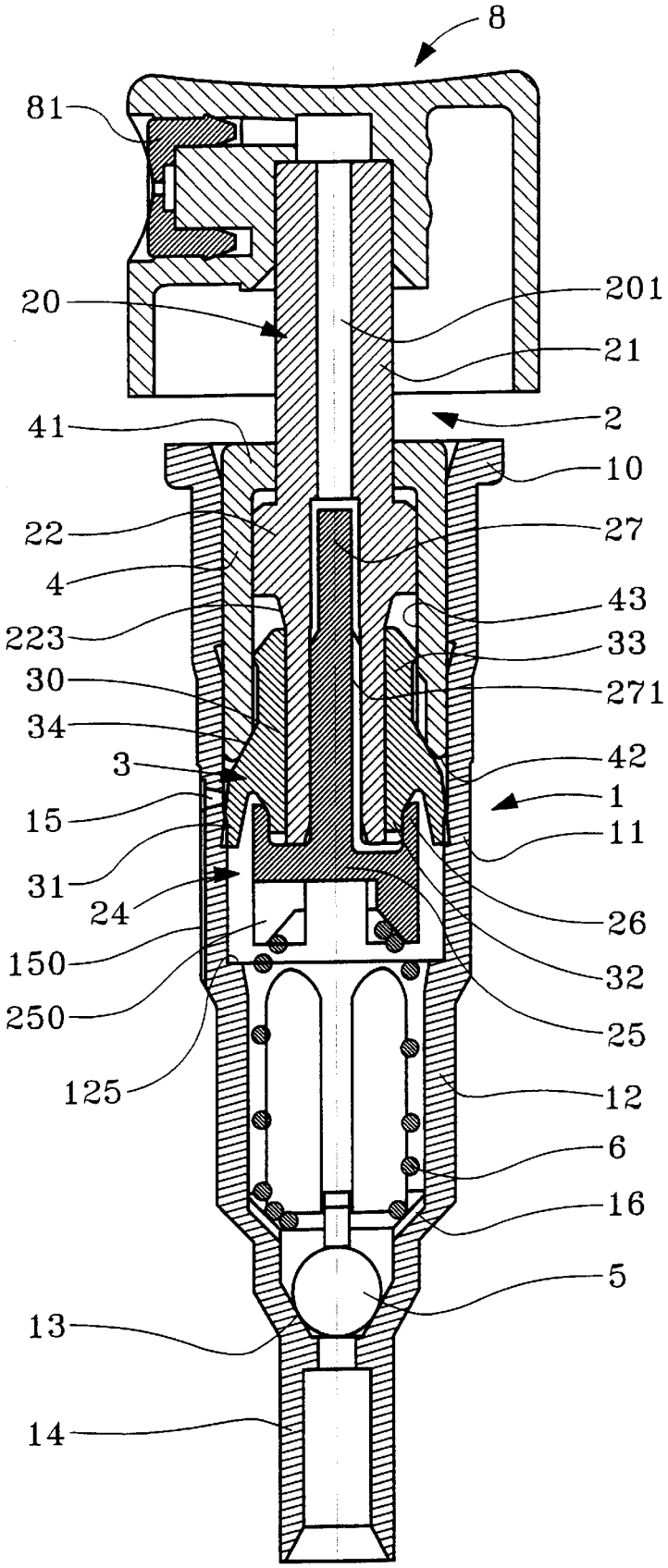
FIG. 1 is a cross sectional view through a hand-operated pump in accordance with the invention.

Now referring to FIG. 1, the pump in accordance with the invention comprises pump body 1 of a generally cylindrical shape exhibiting at its lower end a stationary collar 14 for receiving a conventional plunger tube or dip tube (not illustrated). The pump body likewise defines right above stationary collar 14 an inlet valve seat 13 in the form of an inner, tapered section. As a valve device, there can, for example, be used a steel ball 5 as represented in FIG. 1, but other plastic valve devices, for example, can be used likewise for this purpose.

Above the valve seat 13, the pump body 1 is enlarged to form a cylindrical section 12 which is not perfectly circular, but polygonal so that the inner sides of this section 12 are formed by flat planes. Thus, there is ensured a proper guiding of biconic spring 6 that is housed inside and which often is likely to get out of shape when it is subject to compressive force. The flat planes are thus used as guiding sides to maintain spring 6 perfectly straight.

Above the cylindrical section 12, the pump body 1 forms a shoulder 125 towards the exterior to define another part of cylindrical body section 11. This cylindrical body section 11 defines an inner surface serving as a tight sliding side as will be explained below. This part of the cylindrical body section 11 defines a vent hole 15 which is used for venting air from the pump, as will be explained below. The cylindrical body section 11 terminates at an end with a thickened top end 10 which defines the top opening of the pump body 1 and defines a supporting reference for the unit.

The pump comprises in addition a control rod indicated in its construction by reference number 2 in FIG. 1. This control rod 2 comprises two essential elements connected together, namely, a hollow rod 20 and a peripheral compression device 24. Hollow rod 20 and the peripheral compression device 24 are firmly attached one to the other, but there can likewise be contrived layout shapes in which these two components form a single, unitary part.

Hollow rod 20 defines an inner lift duct 201 that extends along the entire rod length. Hollow rod 20 comprises an upper part 21 intended to project outside of the pump body 1. At its upper end, part of the rod 21 is received in an overlapping distribution head 8 provided with nozzle 81.

At its lower end, part of the upper rod 21 is connected to a part of a median rod 22 with a greater diameter. Thus, there is defined an outer collar between the part of upper rod 21 and the part of the median rod 22. At its lower end, part of median rod 22 is connected to a part of rod 23 with a lesser diameter. In accordance with the invention, the median part 22 with a greater diameter is joined to the lower part 23 with a lesser diameter at a transition defined by a tapered surface 223 whose function will be described hereinafter.

Peripheral compression device 24 connected to hollow rod 20 is formed with central spindle 27 inserted in inner duct 201 of hollow rod 20 at a height corresponding approximately to median part 22 and lower part 23. The central spindle 27 is retained inside duct 201 through radial peripheral webs 271 which mesh with the inner section of duct 201. Between webs 271, a multiplicity of passages are defined which connect the inner duct 201 with the open end of the lower part of the rod 20.

At its lower end, central spindle 27 forms disk 25 whose outer diameter is appreciably greater than that of lower part 23 of hollow rod 20. Disk 25 exhibits a higher surface in which are arranged grooves 28 which are formed in the extension of the fluid passages defined between webs 271 of central spindle 27, as can be seen on FIG. 2. Thus, a flow passage connection is established between the inner end of hollow rod 20 and its upper end.

In accordance with the invention, disk 25 includes a cylindrical peripheral collar 26 that protrudes towards the top starting from the upper surface of disk 25. Accordingly, this cylindrical peripheral collar 26 defines cylindrical surface 261 which is concentric with lower part 23 of rod 20 at a certain height, as can be seen on FIG. 2. Peripheral collar 26 therefore defines with the lower part of rod 23 a ring-shaped receiving seat exhibiting a rectangular groove cross section. This receiving seat communicates with inner duct 201 of hollow rod 20 through groove 28 and passages formed between webs 271.

To force the control rod 2 towards the top outside of pump body 1, the return spring 6 is supported by its lower end against the shoulder that forms pump body 1 right above valve seat 13 and with its upper end against the lower side of disk 25. To avoid having ball 5 forced by an air draining effect against spring 6, slots or notches 16 are defined in the pump body 1 where spring 6 is supported, as can be seen in FIG. 1. Thus, there is always an open fluid passage, even during the aspiration of the product outside of the container.

In addition, the lower side of disk 25 is formed with scalloping 250, thus avoiding any trapping of air in the receiver cavity in disk 25 which houses the upper end of biconic spring 6.

To maintain the control rod 2 inside pump body 1, there is provided ferrule 4 inserted in pump body 1 and having an upper flange 41 that extends radially towards the inside thus to define a central opening across the ferrule 4 which receives the upper part 21 of hollow rod 20. Ferrule 4 is forced into the pump body 1 and is maintained there, for example, by a forked tie effect. Ferrule 4 defines a perfectly cylindrical inner section 43 that is used as a sealed sliding surface, as will be described hereinafter.

In accordance with the invention, a free floating piston, indicated by reference number 3, is mounted in a sliding manner on lower part 23 of hollow rod 20. This piston 3 can be displaced in a limited fashion on lower part 23 of hollow rod 20 to fulfill the outlet valve device function. Piston 3 is formed with an appreciably cylindrical sleeve 30 that surrounds the lower part 23 of hollow rod 20. This collar 30 exhibits upper end 33 and lower end 32. In addition, piston 3 forms outer seal lip 31 adapted to slide tightly against the inner wall of pump body 1 in upper part 11. More specifically, piston 3 slides in this inner section of pump body 11 in a part that is situated between shoulder 125 and vent hole 15. Lip seal 31 connects with sleeve 30 by forming shoulder 34. When the pump is in lock position, that which corresponds to FIG. 1, lower end 32 of sleeve 30 is sealingly disposed in the receiver formed by the lower end of lower part 23 of rod 20 and peripheral collar 26 of peripheral compression device 24. The width of the lower end 32 of the inner sleeve 30 is equal to or a little greater than the distance separating the outer surface of inner part 23 of hollow rod 20 and the inner, concentric, peripheral surface 261 of collar 26. Thus, lower end 32 of sleeve 30 is received via clamping and radial compression in the receiver formed by rod 23 and collar 26. There ensues a cylindrical sealing contact of a certain height. Accordingly, the sealing contact that exists between lower end 32 of the sleeve 30 and the collar 26 is broken only when the sleeve 30 has undergone a vertical displacement towards the top through a distance greater than the height of the contact seal. As a result, the piston must effect lost motion of a certain distance before opening the fluid passage and allowing flow through inner duct 201 and liquid spray diffuser 81.

On the other end, sleeve 30 extends with its higher top 33 around tapered surface 223 that forms the transition between median part 22 and lower part 23 of hollow rod 20. Accordingly, as soon as the piston will be displaced towards the top by the effect of pressure increase inside the pump chamber, its higher end 33 will function on this tapered surface 223. To allow for the functioning of sleeve 30 on this tapered surface 223, the piston is produced from a supple material that is appreciably moldable. Thus, the involvement of upper end 33 of the sleeve yields a growing resistance insofar as the piston mounts on this surface. To allow for the opening of the passage at the lower end of control rod 2, the piston will have to effect movement towards the top by functioning on tapered surface 223, and this movement must be greater than the cylinder seal contact height that is defined between the lower end 32 of sleeve 30 and the peripheral inner surface 261 of collar 26. The precompression is thus directly dependent on three factors, namely, the height of the tightness contact, the conical angle of the tapered surface, and the distortion capacity of the material used for making piston 3. It is to be noted that with the pump in accordance with the invention, you can go from the precompression spring that asks for the piston in its lock position.

In accordance with another interesting characteristic, sleeve 30 in the lock or rest position as represented in FIG. 1 is not subjected to any distortion stress that would be imposed in the axial direction of the pump. Indeed, in the lock position, the sleeve has support with shoulder 34 against lower inner edge 42 of ferrule 4. In this position, higher end 33 of the sleeve does not function on tapered surface 223, and lower end 32 of the sleeve functions perfectly in the receiver formed by rod 23 and collar 26 of peripheral compression device 24. Accordingly, in the lock or rest position, return spring 6 ensures a perfect, highly effective valve seal by facilitating the clamping of lower part 32 of sleeve 30 and shoulder support 34 against ferrule 4.

Particularly, the sleeve lower part 32 includes a tapered or conical surface 263 which is pressed at a position 262 by an inside surface of the collar 26.

Figure 2:
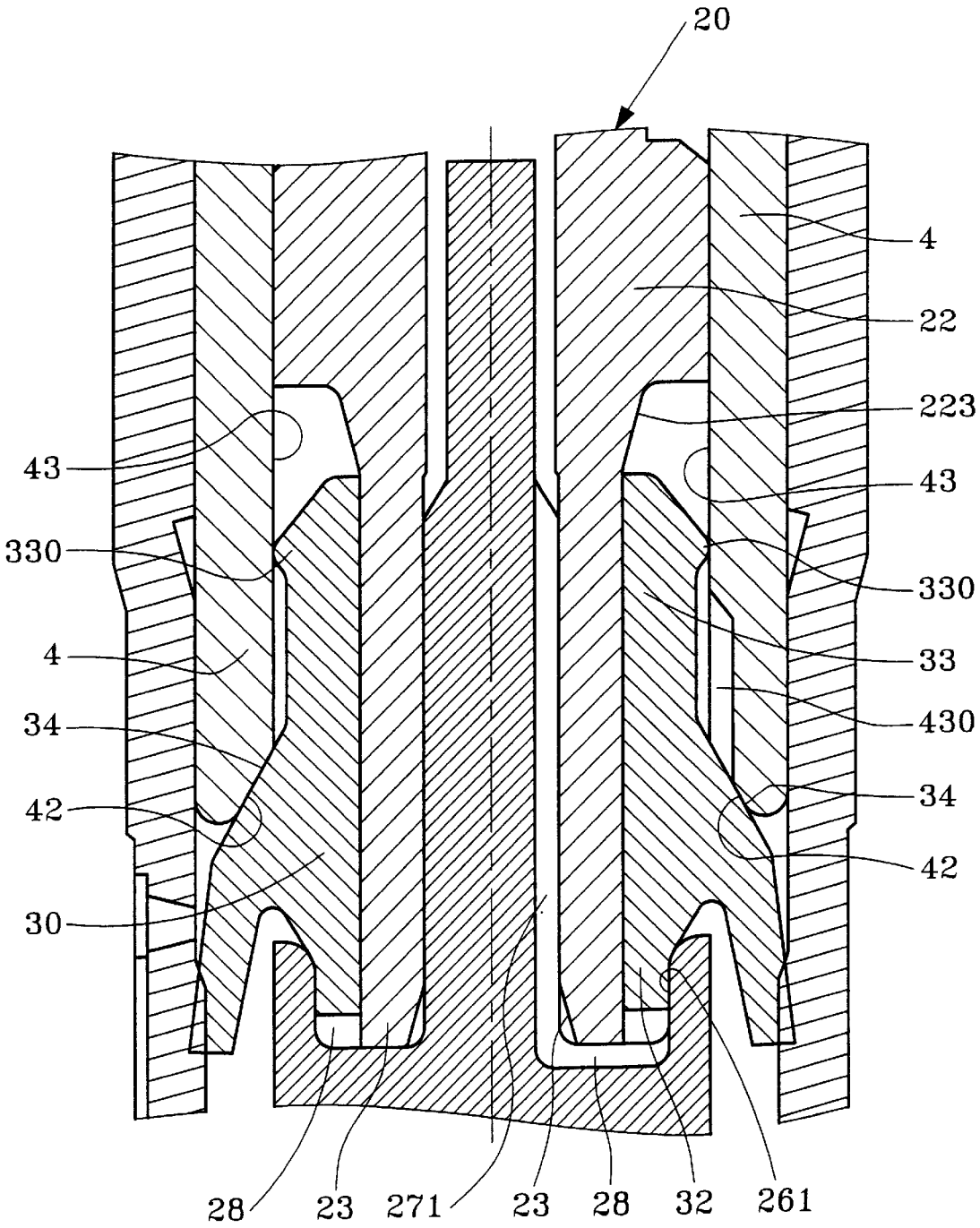
FIG. 2 is an enlarged scale view of a portion of the pump shown in FIG. 1.

According to another characteristic of the invention, sleeve 30 is provided with near its upper end 33 outer peripheral seal bead or cord 330 that slides tightly against inner section 43 of ferrule 4, as can be seen in FIG. 2. This outer peripheral seal bead or cord 330 is separate from the inner atmosphere of the container on which the pump would be set. Indeed, given that seal cord 330 is in contact with a tight seal against inner section 43 of ferrule 4, there is no connection between the inside and the outside of the container on which would be mounted on the pump across vent hole 15. Fortunately, groove 150 is formed in the pump body that joins vent hole 15 to cylindrical section 12 in order to prevent the vent hole from being sealed by the inner section of the container neck. We can see clearly in FIG. 1 that seal cord 330 only leaves inner section 43 of ferrule 4 at the bottom end of the run or compression stroke, namely, only when lip seal 31 of the piston 30 arrives near shoulder 125 defined in the pump body 1. Thus, contrary to prior technique pumps, venting into open atmosphere occurs only at the end of the run or compression stroke so that the container interior is isolated from the outside ambient atmosphere during the major part of the piston run or downward compression stroke.

As a variant represented on FIG. 2, inner section 43 of ferrule 4 can be supplied with one or several slots 430 that extend to the end of the ferrule. Accordingly, venting into open air will occur as soon as bead or cord 330 arrives at the top of the slot(s) 430. There can thus be regulated very precisely the moment of venting into the ambient atmosphere by adjusting the top of the slots. The higher the slots starting at the lower end of the ferrule, then the earlier venting to ambient atmosphere will occur. In addition, it is possible to adjust the vent flow to open air by springing off on the total tapered section of slot. Because of these slots, it is possible to adjust precisely the time and the quantity of the vent flow into ambient atmosphere. Of course, we can easily envisage at the location of the slot(s) a peripheral step that enters a greater diameter cylindrical section. The purpose is to create a recess-defining an air passage between cord 330 and inner side 43 of ferrule 4 on a predetermined location and with a predetermined flow.

Figure 3:
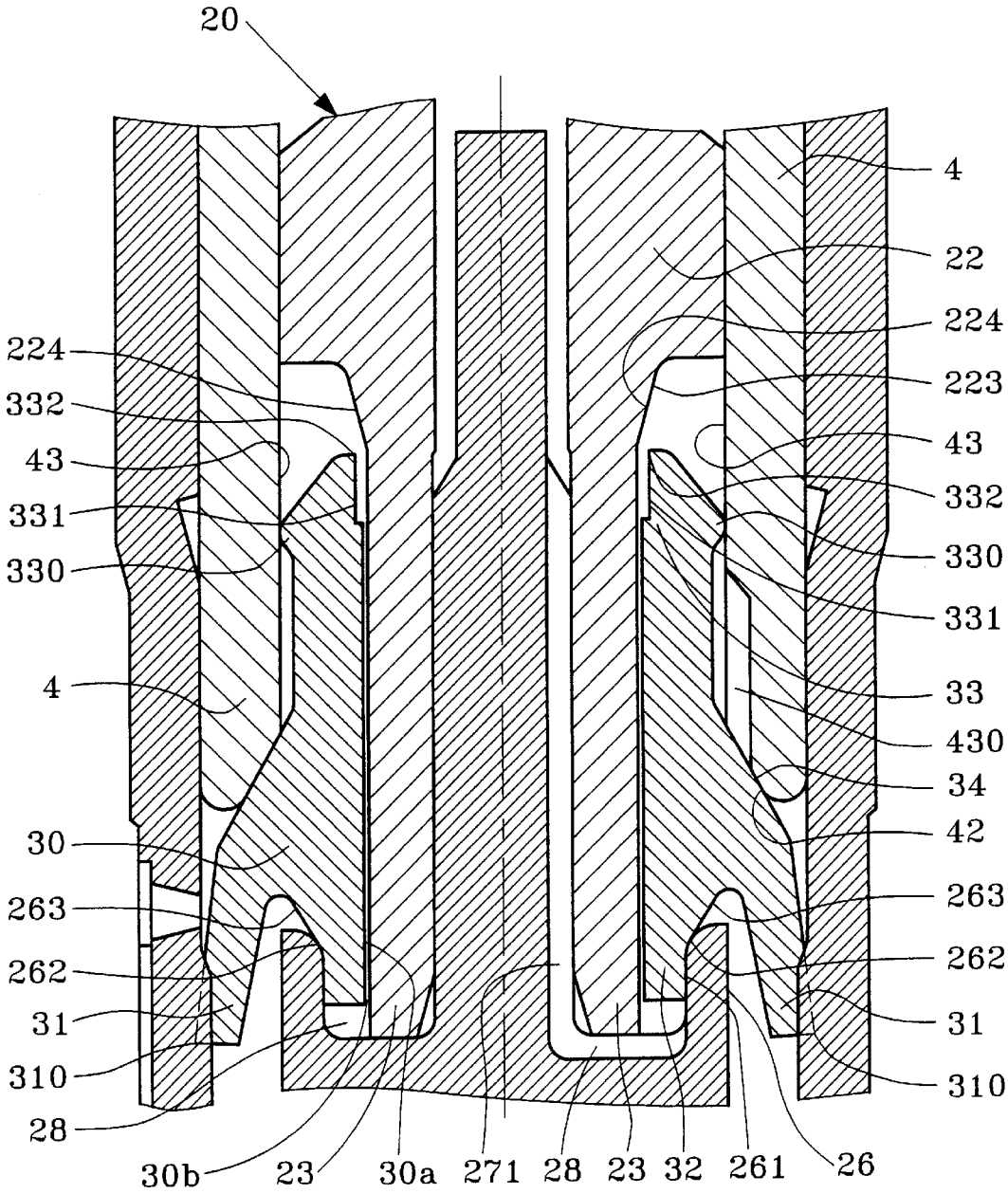
FIG. 3 is an enlarged scale view of a portion of an alternate embodiment pump of the invention.

FIG. 3 illustrates a modification of the pump shown in FIG. 2. In this embodiment a modified sleeve 30' is illustrated. Accordingly, in FIG. 3, identical reference numbers to those shown in FIGS. 1 and 2 describe substantially identical features as previously described. The sleeve 30' includes a modified central bore 30*a* which includes a clearance 30*b* between the sleeve 30' and the rod portion 23 to eliminate friction between the sleeve 30' and the rod portion 23.

Additionally, the upper part 33 of the sleeve 30' includes a step or recess 331 defining a ridge 332 adapted to engage the surface 223 of the section at the location 224 when sliding in an upward direction.

The function of the recess 331 in the sleeve 30' is that the sleeve 30' will not immediately engage the surface 223 when sliding in the upward direction.

The above-described modifications lessen the chance that the sleeve 30' could jam on the frustoconical surface 223 of the actuating rod 20.

The vertical distance between the ridge 332 and the location 224 is slightly shorter than the height of the lower part 32 of the sleeve that is engaged in the collar 26. Therefore, the ridge 332 makes sealing contact with the surface 223 before the lower part 32 disengages from the collar 26. Thus, there is always a sealing contact with the rod 20.

The sleeve 30' is not under axial (vertical) stress in the rest position. The sleeve 30' is only axially compressed during the dispensing phase, when the ridge 332 at the top of the sleeve 30' is engaged by the downward moving surface 223 of the actuating rod 20 and the bottom of the sleeve 30' is subjected to an upward force from the internal fluid pressure. In the rest position, only a small outer portion of the sleeve 30' is compressed between the ferrule 4 and the position 262, leaving the entire inner height of the sleeve substantially unstressed in an axial direction.

Now there will be described quickly a complete control cycle regarding the pump described above. In the position represented on FIG. 1, the pump is in the lock position. Return spring 6 biases the control rod 2 towards the top so that shoulder 34 of piston 3 is thrust against the inner lower bottom edge of ferrule 4. Lower end 32 of sleeve 30 is sealed between the lower end of the part of lower rod 23 and collar 26 of peripheral compression device 24. Upper end 33 of the sleeve is not yet contacting or engaged with tapered surface 223 of hollow rod 20. In this position, the inside of the pump chamber is perfectly isolated from the outside ambient atmosphere.

By pressing against, for example with a finger, hydraulic head 8, the control rod 2 is moved downwardly in pump body 1. In this initial phase of the lowering of the rod, shoulder 34 of piston 3 is moved away from its stop contact with lower edge 42 of ferrule 4, being that this latter element is a stationary pump element. The lowering of control rod 2 into the pump chamber involves a reduction of volume of the latter, and that increases the pressure to bias piston 3 towards the top by sliding on lower part 23 of hollow rod 20. Thus, insofar as control rod 2 is lowered in pump body 1, piston 3 rises on the control rod. The rising of the piston on the rod forces the upper end 33 of sleeve 30 on tapered surface 223 and causes the release of lower end 32 of sleeve 30 from the receiving area defined by collar 26. The movement of piston 3 towards the top on rod 23 takes place until lower end 32 of sleeve 30 is completely released from the receiver, so that there is no longer any sealing contact between the sleeve 30 and collar 26. At this time, the passage is open between the inside of the pump chamber and inner duct 201 of the control rod across grooves 28 and the passages defined between webs 271. Pressurized fluid in the pump chamber consequently can escape through the control rod to nozzle 81 where it is sprayed in fine droplets.

When the downward movement or penetration of control rod 2 is concluded, seal lip 31 of the piston stops against shoulder 125 defined by the pump body 1. At this time, the proportioning chamber is completely cleared, and there is no longer any internal pressure. Piston 3 is then no longer forced upwardly by pressure, but it remains in place for a brief moment owing to the forces of friction. On the other hand, rod 2 is moved up with the biasing action of spring 6 insofar as the consumer releases the finger pressure on head 8. The displacement of the rod in relation to the still stationary piston has as an effect of releasing the end 33 of the piston from the tapered surface 223.

The releasing of upper part 33 of the sleeve is possible given the elasticity of the sleeve and the conical angle of the surface 223. Tapered surface 223 acts as a precompression spring and biases the piston 3 in its lock position where lower end 32 of the sleeve 30 comes back into cylindrical sealing contact inside the receiver defined by collar 26. When control rod 2 returns to its fully raised, lock position under the influence of return spring 6, shoulder 34 of piston 3 stops against inner lower edge 42 of ferrule 4, and that also contributes to the penetration of lower end 32 of the sleeve in the receiver defined in collar 26. Thus, the pump has returned to the position represented in FIG. 1, and that concludes the control cycle.

Regarding the venting, outer seal bead or cord of sleeve 30, during the downward movement and further penetration of rod 2, is in tight sliding contact with inner side 43 of ferrule 4. It is only when lip seal 31 of piston 3 comes in contact against shoulder 125 of pump body 1 that the seal cord 330 is carried below, and out of engagement with, inner surface 43 of the ferrule, to allow outer ambient air to flow into the container in which the pump would be mounted because the ambient air can pass between the ferrule and the control rod, over the piston 3, and then through vent hole 15.

What is claimed is:

1. A hand operated pump for fluid distribution comprising:

a) a pump body defining a pump chamber supplied with an inlet valve;

b) a hollow control rod movable in said pump body between a rest position and a depressed, lower position, said rod biased to said rest position by a return spring, said rod comprising an inner lift duct;

c) a free floating piston assembled in a sliding manner in said pump body and on said rod to define an outlet valve for sealing the inner lift duct in the rest position of the control rod;

d) the rod comprising a stop surface, said piston cooperating with said surface during its upward sliding to provide a sealing at this level;

e) said piston comprises a sleeve surrounding said control rod, said sleeve having a lower end in cylindrical sealing contact with said control rod in said rest position and a upper end adapted to function on said stop surface of said rod during the slide of the piston towards the top;

f) said sleeve having an inner diameter greater than the outer diameter of said rod;

g) the upper end of said sleeve defining an upper circular sealing stop ridge adapted to engage the stop surface of the rod, said stop ridge being in spaced relationship with the stop surface of the rod in rest position, said cylindrical sealing contact being broken by upward sliding of said piston on the rod at such a height that the stop ridge sealingly engages the stop surface before the cylindrical sealing contact of the outlet valve is broken, thus providing a precompression.

2. A pump in accordance with claim 1, wherein the stop surface is frustoconical toward the exterior.

3. A pump in accordance with claim 2, wherein the sealing stop ridge is defined by the upper end of an inner step.

4. A pump in accordance with claim 1, in which said piston comprises a means to compress the radially inner end of said sleeve.

5. A pump in accordance with claim 4, in which said rod has at its lower end a peripheral compression device allowing for the compressing of said lower end of said sleeve between said rod and said peripheral device.

6. A pump in accordance with claim 5, in which said peripheral compression device comprises a concentric cylindrical surface on the rod, and a receiver groove with a seal clamping for the lower end of the sleeve, said receiver groove establishing communication between the inside of the control rod and the pump chamber.

7. A pump in accordance with claim 1, in which said piston comprises a peripheral shoulder located at an intermediate point between the upper end and the lower end of said sleeve, said shoulder being supported against a stationary element of the pump when the rod is in the rest position so that said sleeve is not in compression at the rest position.

8. A pump in accordance with claim 1, in which said sleeve comprises an outer peripheral cord seal adapted to slide in a tight manner against an inner cylindrical section of said pump body from the rest position until about the lower position where the cord abandons said section so as to allow atmospheric venting only at the end of the stroke.

9. A pump in accordance with claim 8, in which the inner cylindrical section is provided with at least a recess allowing for passage of air between said cord and inner cylindrical section so as to accelerate the establishment of atmospheric venting.

10. A pump in accordance with claim 1, in which said sealing ridge is adapted to engage the stop surface of the rod just before the cylindrical sealing contact of the outlet valve is broken.

* * * * *